US010892557B1

(12) United States Patent
Liu

(10) Patent No.: US 10,892,557 B1
(45) Date of Patent: Jan. 12, 2021

(54) ANTENNA STRUCTURE AND INTELLIGENT HOUSEHOLD APPLIANCE USING THE SAME

(71) Applicant: AMBIT MICROSYSTEMS (SHANGHAI) LTD., Shanghai (CN)

(72) Inventor: Yen-Yu Liu, New Taipei (TW)

(73) Assignee: AMBIT MICROSYSTEMS (SHANGHAI) LTD., Shanghai (CN)

( * ) Notice: Subject to any disclaimer, the term of this patent is extended or adjusted under 35 U.S.C. 154(b) by 0 days.

(21) Appl. No.: 16/445,346

(22) Filed: Jun. 19, 2019

(51) Int. Cl.

| | |
|---|---|
| ***H01Q 9/06*** | (2006.01) |
| ***H01Q 9/04*** | (2006.01) |
| ***H01Q 13/10*** | (2006.01) |
| ***H01Q 1/00*** | (2006.01) |
| ***H01Q 1/22*** | (2006.01) |

(52) U.S. Cl.
CPC ..... *H01Q 9/065* (2013.01); *H01Q 1/007* (2013.01); *H01Q 1/2208* (2013.01); *H01Q 9/0407* (2013.01); *H01Q 13/106* (2013.01)

(58) Field of Classification Search
CPC ..... H01G 9/065; H01G 1/007; H01G 1/2208; H01G 13/106; H01G 9/0407
See application file for complete search history.

*Primary Examiner* — Graham P Smith
(74) *Attorney, Agent, or Firm* — ScienBiziP, P.C.

(57) ABSTRACT

An antenna structure capable of operating in several modes includes first and second metal patches and a substrate (which can be an air-filled void) positioned between them. The second patch is substantially an isosceles trapezoidal patch. The second patch includes a first bottom edge, a second bottom edge parallel to and spaced from the first bottom edge, a first side edge, a second side edge, a first shorting wall, and a second short circuit patch. The first side edge and the second side edge are connected to the first bottom edge and the second bottom edge. The first shorting wall and the second shorting wall are formed between the first patch and the second patch. The second patch further defines a V-shaped slot.

20 Claims, 14 Drawing Sheets

ANTENNA STRUCTURE AND INTELLIGENT HOUSEHOLD APPLIANCE USING THE SAME

FIELD

The subject matter herein generally relates to antennas.

BACKGROUND

A typical triangular planar inverted-F antenna commonly includes a metal radiating sheet. An embedded slot is defined in the radiating sheet to form two arms, forming resonant paths of different lengths. In addition, a width of a short-circuiting metal patch of the antenna can be changed to adjust an operating frequency of the antenna, exciting a first resonant mode (TM10) and a second resonant mode (TM20). However, the first resonant mode (TM10) and the second resonant mode (TM20) have similar broadside radiation patterns. Therefore, the application of the triangular planar inverted-F antenna is relatively simple.

There is room for improvement within the art.

BRIEF DESCRIPTION OF THE DRAWINGS

Implementations of the present disclosure will now be described, by way of embodiment, with reference to the attached figures.

DETAILED DESCRIPTION

Figure 1:
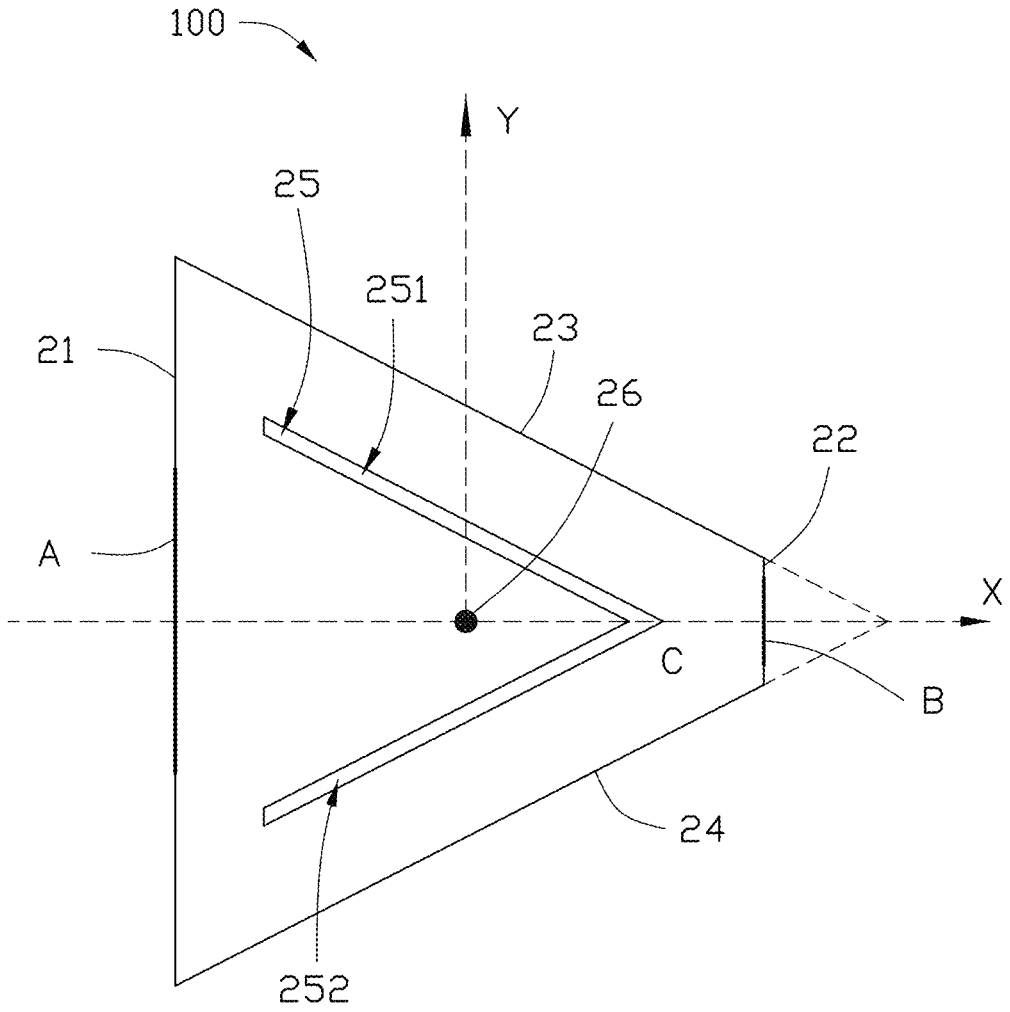
FIG. 1 is a top view of a first embodiment of an antenna structure applicable in an intelligent household appliance.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" when utilized, means "including, but not necessarily limited to"; it specifically indicates open-ended inclusion or membership in the so-described combination, group, series, and the like.

The present disclosure is described in relation to an antenna structure and an intelligent household appliance using the same.

Figure 2:
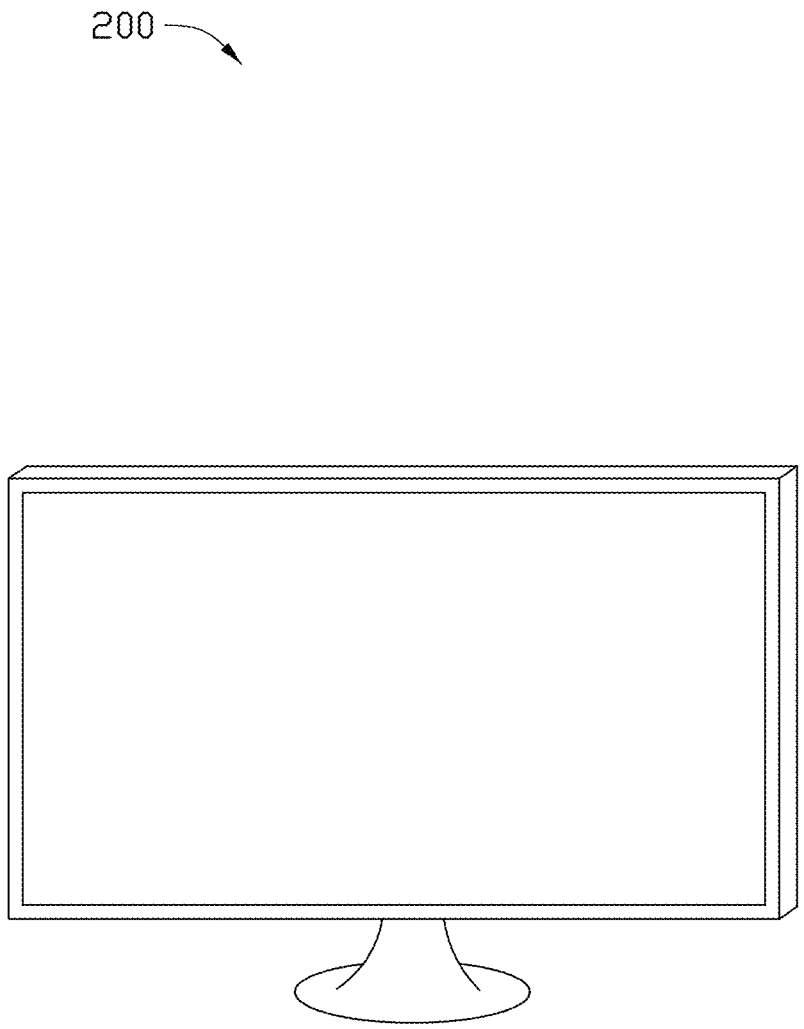
FIG. 2 is an isometric view an embodiment of an intelligent household appliance using the antenna structure of FIG. 1.

FIG. 1 illustrates a first embodiment of antenna structure 100 used in an intelligent household appliance 200 (see FIG. 2). The antenna structure 100 is configured for receiving and transmitting wireless signals. The intelligent household appliance 200 can be, for example, a smart television. In this embodiment, the antenna structure 100 is a microstrip antenna.

Figure 3:
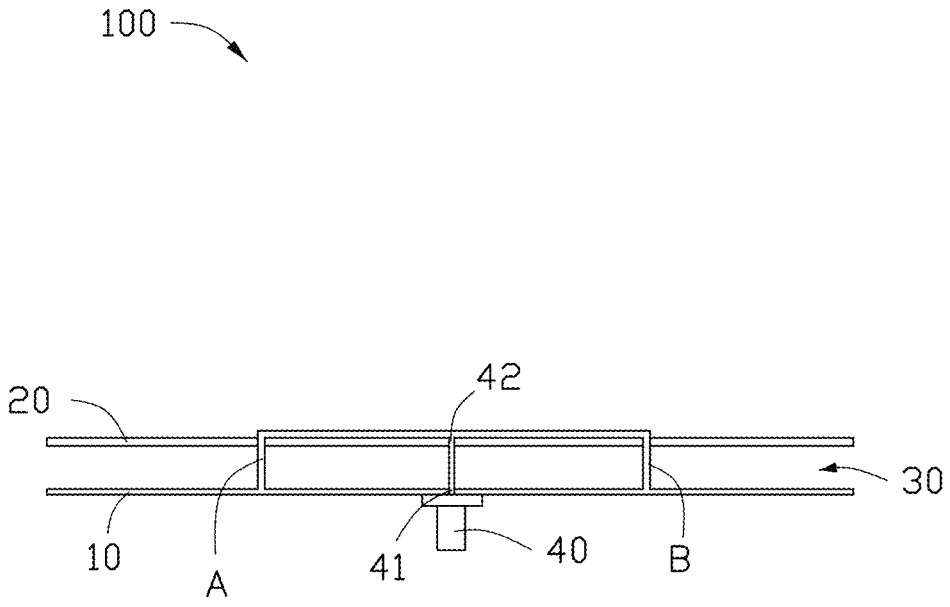
FIG. 3 is a side view of a second patch of the antenna structure of FIG. 1.

Also referring to FIG. 3, the antenna structure 100 includes a first patch 10, a second patch 20, and a substrate 30 formed between the first patch 10 and the second patch 20. In this embodiment, the first patch 10 is a grounded metal patch. The second patch 20 is a printed circuit board made of FR4 materials. The antenna structure 100 further includes a connecting device 40. The connecting device 40 includes a first connecting end 41 and a second connecting end 42. The first connecting end 41 is grounded. The second connecting end 42 passes through the first patch 10 and the substrate 30, and is electrically connected to a feeding point 26 of the second patch 20. Because the substrate 30 is made of insulating materials, an operating frequency and a bandwidth of the antenna structure 100 can be changed by employing insulating materials with different dielectric constants. In this embodiment, the substrate 30 is formed by air.

In this embodiment, the second patch 20 is substantially an isosceles trapezoidal patch having an embedded V-shaped slot. The second patch 20 includes a first bottom edge 21, a second bottom edge 22, a first side edge 23, and a second side edge 24. The first bottom edge 21 and the second bottom edge 22 are parallel to and spaced from each other. The first side edge 23 and the second side edge 24 are connected to the first bottom edge 21 and the second bottom edge 22. A first shorting wall A and a second shorting wall B are formed between the first patch 10 and the second patch 20. In this embodiment, the first shorting wall A and the second shorting wall B are metal patches.

A substantially V-shaped slot 25 is defined in the second patch 20. The slot 25 includes a first section 251 and a second section 252. The first section 251 intersects with a second section 252 to form an angle C therebetween. The first section 251 is parallel to and spaced from the first side edge 23. The second section 252 is parallel to and spaced from the second side edge 24. A length of the first section 251 is the same as that of the second section 252. The first section 251 and the second section 252 are symmetrically positioned relative to a central line (Y-axis) of the second patch 20.

In this embodiment, the second patch 20 is formed by placing the second shorting wall B into an equilateral triangular metal patch. The second connection end 42 is connected to a center of the equilateral triangle.

Figure 4:
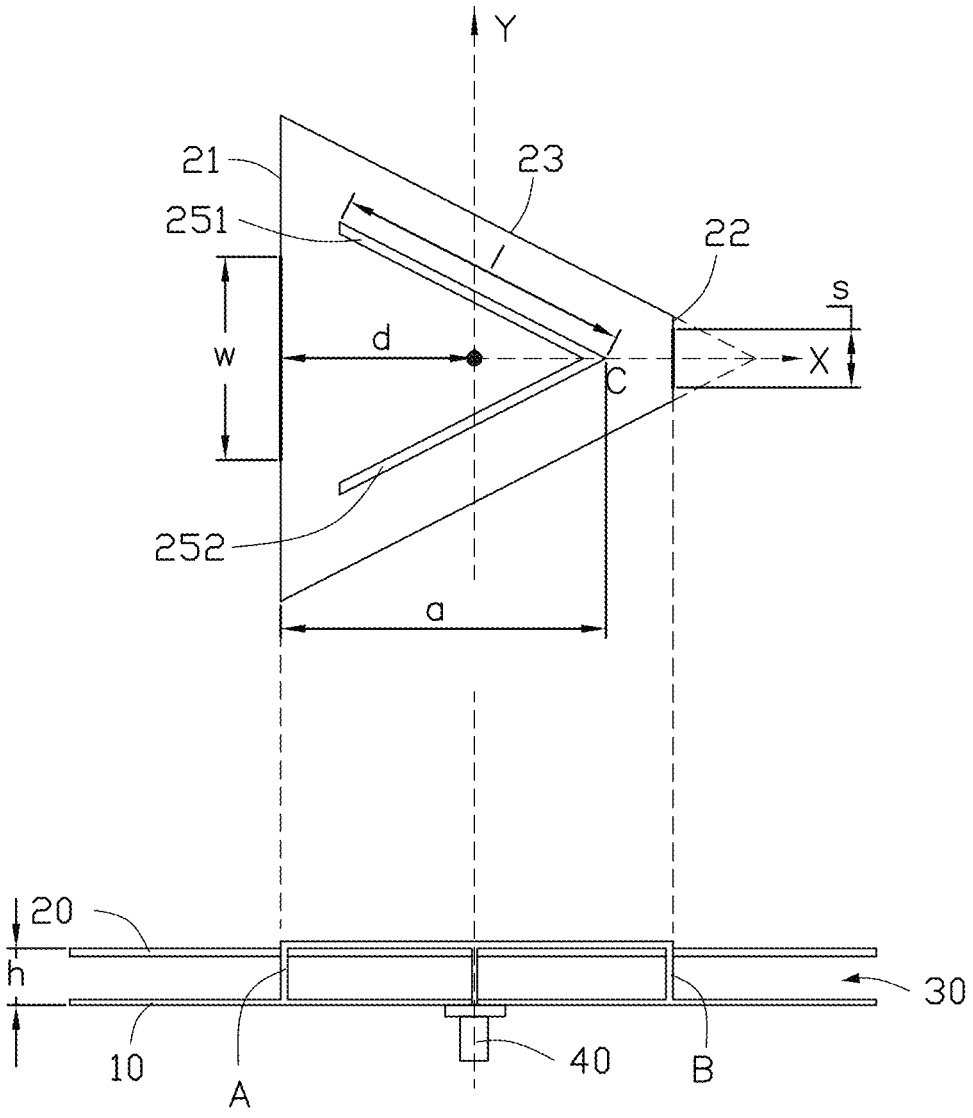
FIG. 4 is a dimensional view of the antenna structures of FIG. 1 and FIG. 3.

Referring to FIG. 4, a width of the first shorting wall A is distance w, a width of the second shorting wall B is distance s, lengths of the first section 251 and of the second section 252 are both 1. A distance from the angle C to the first bottom edge 21 is distance a. A height of the antenna structure 100 is distance h. A distance from the center of triangle to the second bottom edge 22 is distance d. In this embodiment, w=27 mm, s=1 mm, 1=36 mm, a=42 mm, d=26 mm, and h=6 mm.

Figure 5:
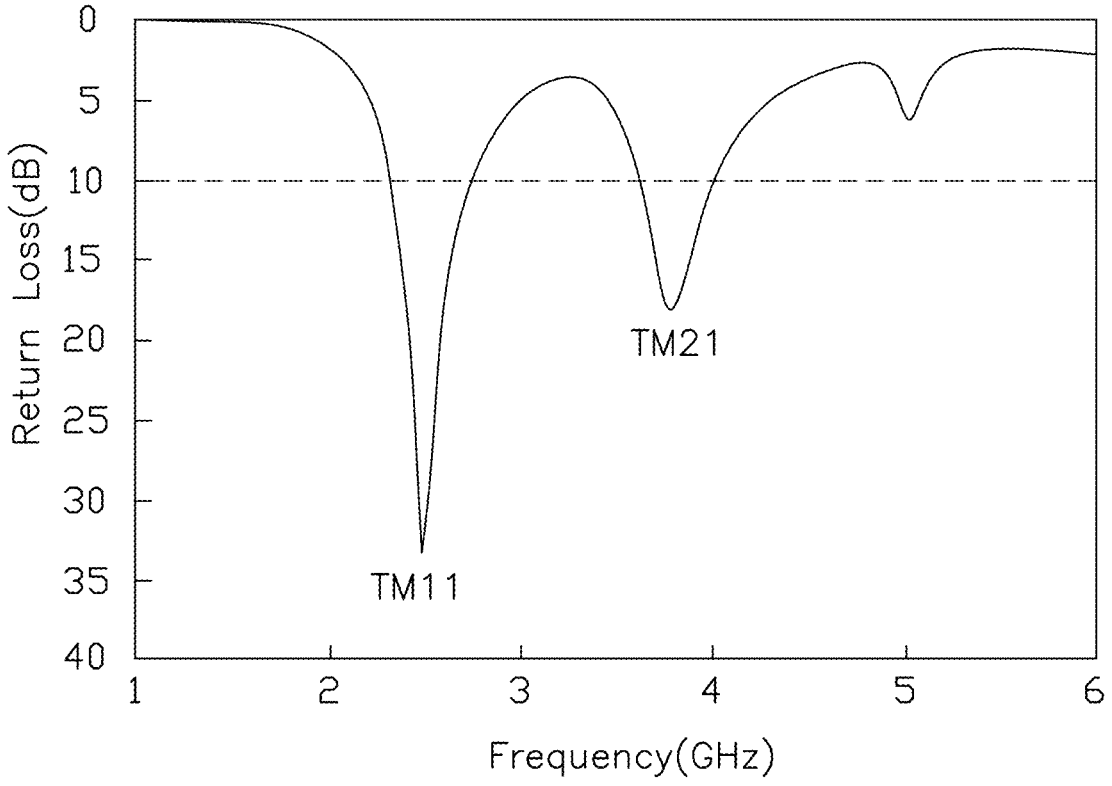
FIG. 5 is a return loss graph of the antenna structure illustrated in FIG. 1.

Referring to FIG. 5, the antenna structure 100 can be excited into a first resonant mode (TM11) and a second resonant mode (TM21). A resonant frequency of the first resonant mode (TM11) is about 2530 MHz. A resonant frequency of the second resonant mode (TM21) is about 3815 MHz.

Figure 6A:
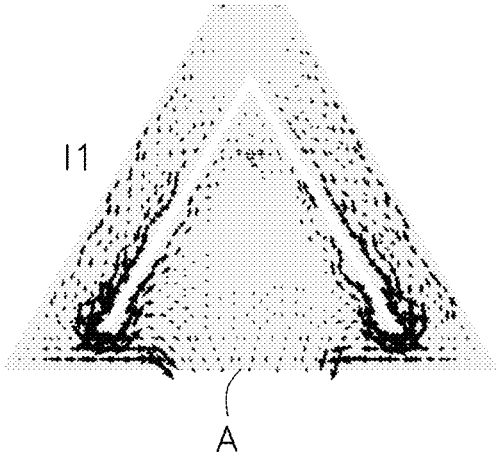
FIGS. 6A, 6B, 6C, and 6D show patch surface current distributions of the antenna structure illustrated in FIG. 1 when excited 1 in a first resonant mode and in a second resonant mode.
Figure 6B:
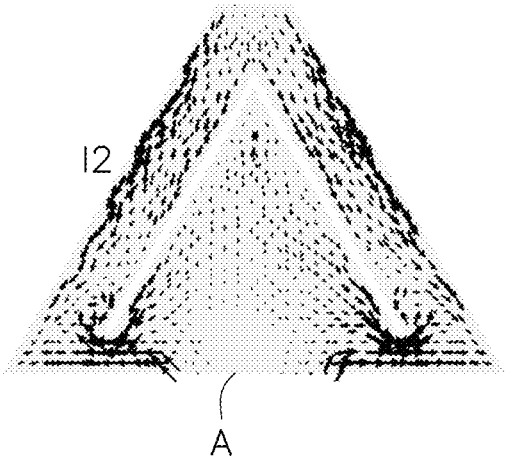
Figure 6C:
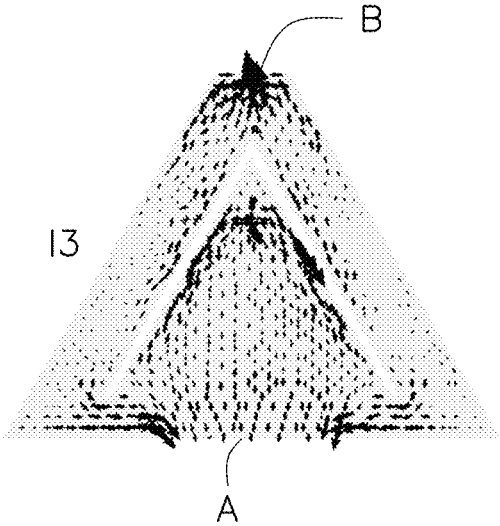
Figure 6D:
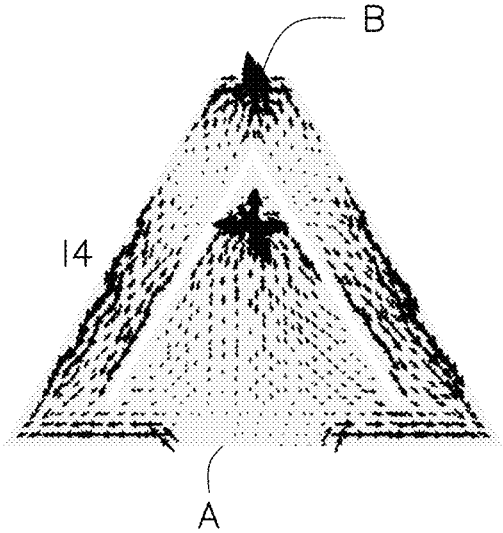

Referring to FIGS. 6A and 6B, patch surface currents of the first resonant mode (TM10) and the second resonant mode (TM20) of a typical triangular microstrip antenna are I1 and I2. Referring to FIGS. 6C and 6D, patch surface currents of the first resonant mode (TM11) and the second resonant mode (TM21) of the antenna structure 100 when excited are I3 and I4.

The patch surface current I1 mainly flows along the V-shaped slot 25. The patch surface current I2 mainly flows along the triangle. The current distributions of these modes at a truncated portion of the triangle (where the second shorting wall B is positioned) is zero. When the second shorting wall B is added to the antenna structure 100, the current at the truncated portion of the triangle will no longer be zero. In this way, the first resonance mode (TM10) and the second resonance mode (TM20) can be suppressed. A portion of the surface excitation current I3 flows along an inner side of the groove 25 toward the first short-circuit body A, and the other portion of the surface excitation current I3 flows along an outer side of the groove 25 toward the second short-circuit body B. The surface excitation current I4 mainly flows along edge of the triangle toward two bottom corners of the triangle and the second shorting wall B.

Figure 7A:
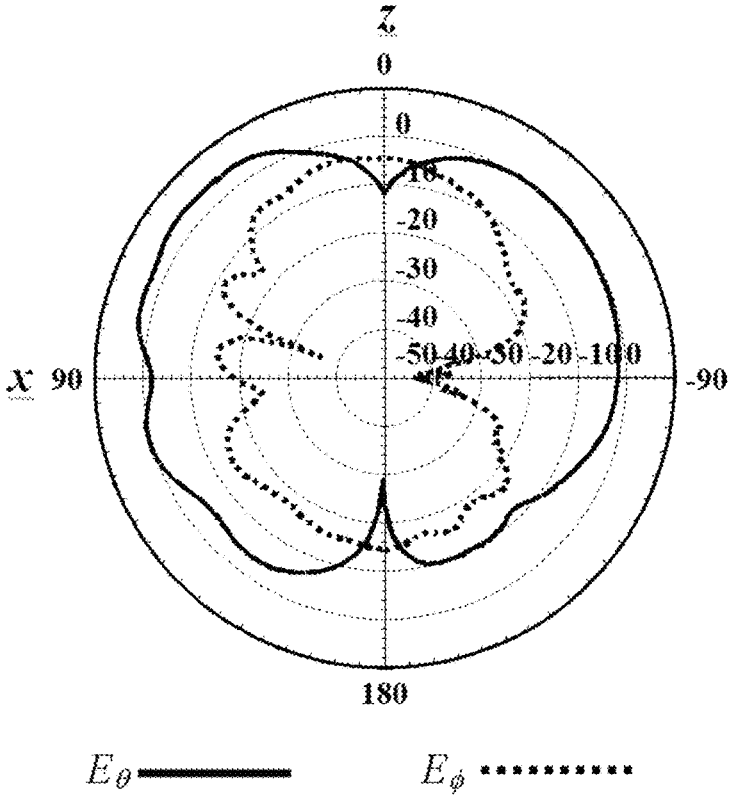
FIGS. 7A, 7B, and 7C are radiation pattern graphs of the antenna structure illustrated in FIG. 1 in the first resonant mode.
Figure 7B:
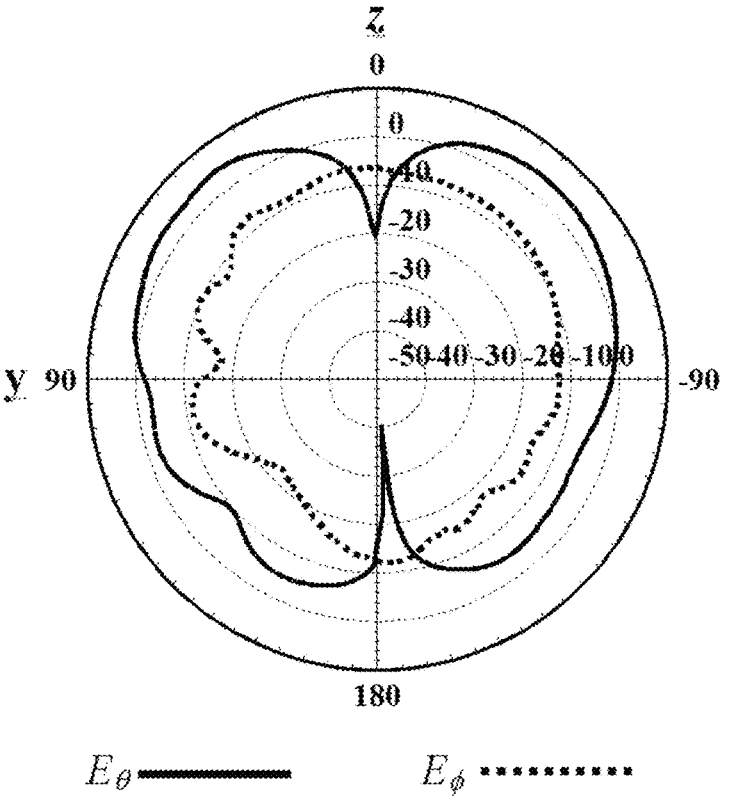
Figure 7C:
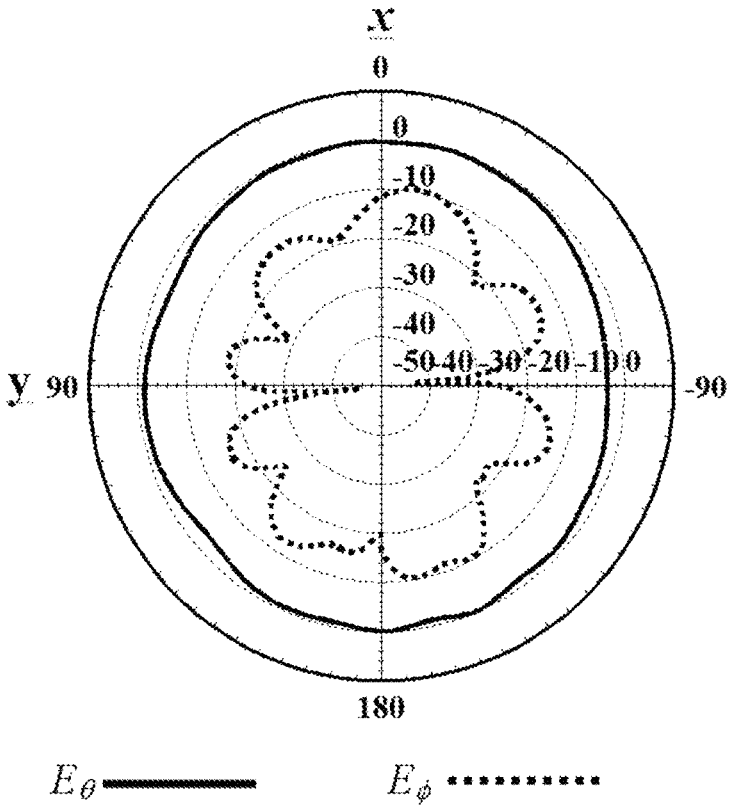
Figure 8A:
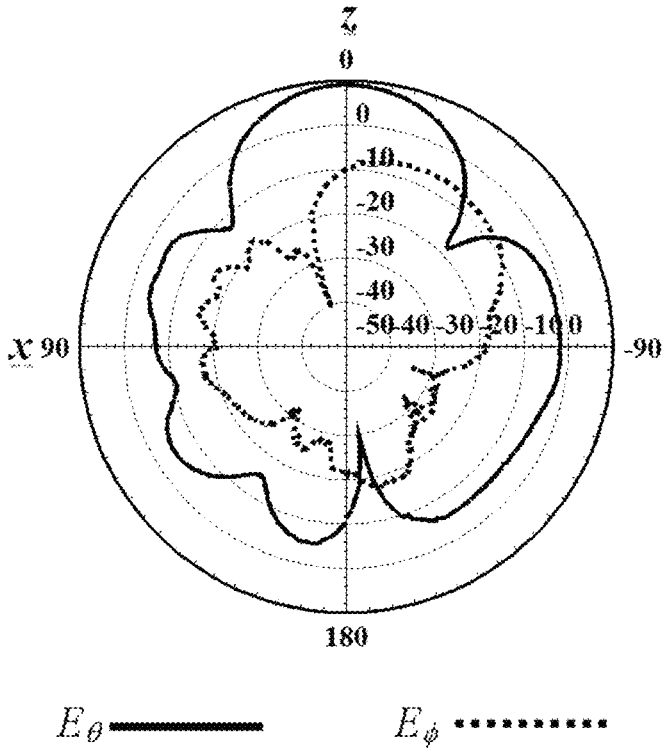
FIGS. 8A, 8B, and 8C are radiation pattern graphs of the antenna structure illustrated in FIG. 1 in the second resonant mode.
Figure 8B:
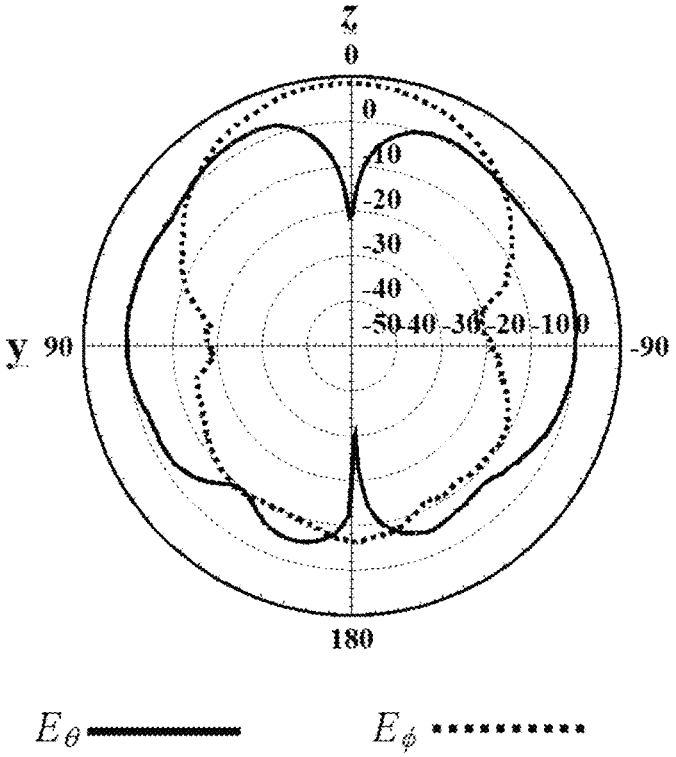
Figure 8C:
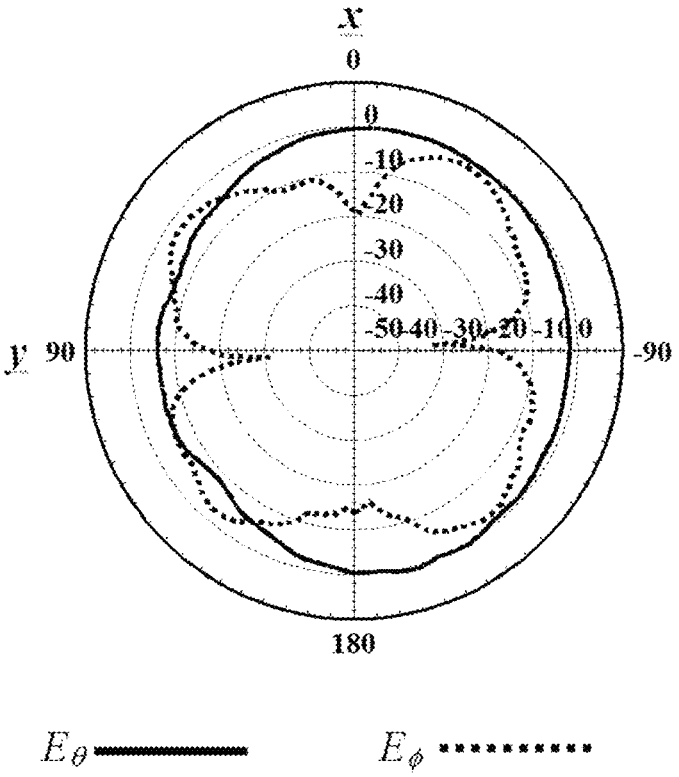

FIGS. 7A, 7B, and 7C shows radiation pattern graphs of the antenna structure 100 operating in the first resonant mode (TM11). FIGS. 8A, 8B, and 8C shows radiation pattern graphs of the antenna structure 100 operating in the second resonant mode (TM21). As shown in tests, the first resonant mode (TM11) has a radiation pattern similar to that of a dipole antenna, and the second resonant mode (TM21) has a broadside radiation pattern.

In a second embodiment of the present disclosure, the widths of the second shorting wall B can be gradually increased, for example, s=3 mm or 7 mm, and at this time, the resonant frequency and the matching impedance of the first resonant mode (TM11) are slightly changed, and the antenna structure 100 will operate in a third resonant mode (M3). The resonant frequency of the third resonant mode (M3) can be gradually shifted toward a high frequency direction (as shown in FIG. 8) when the length of the second shorting wall B is gradually increased.

Figure 9:
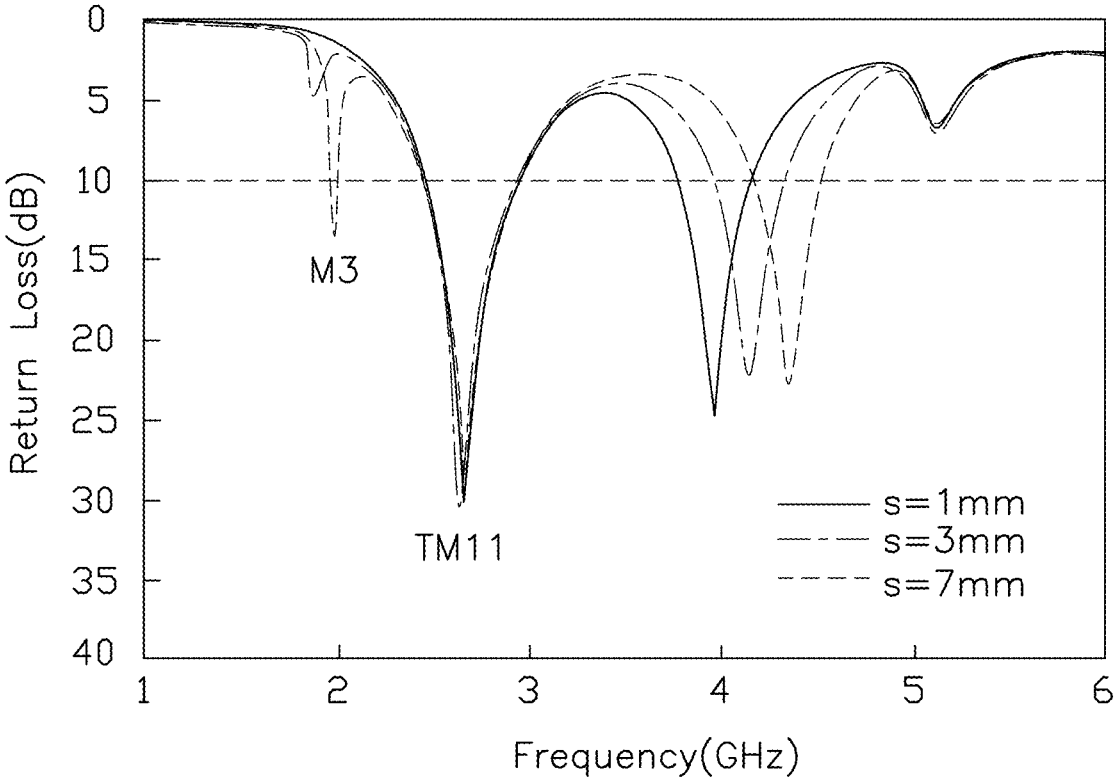
FIG. 9 is a return loss graph of a second embodiment of an antenna structure.
Figure 10A:
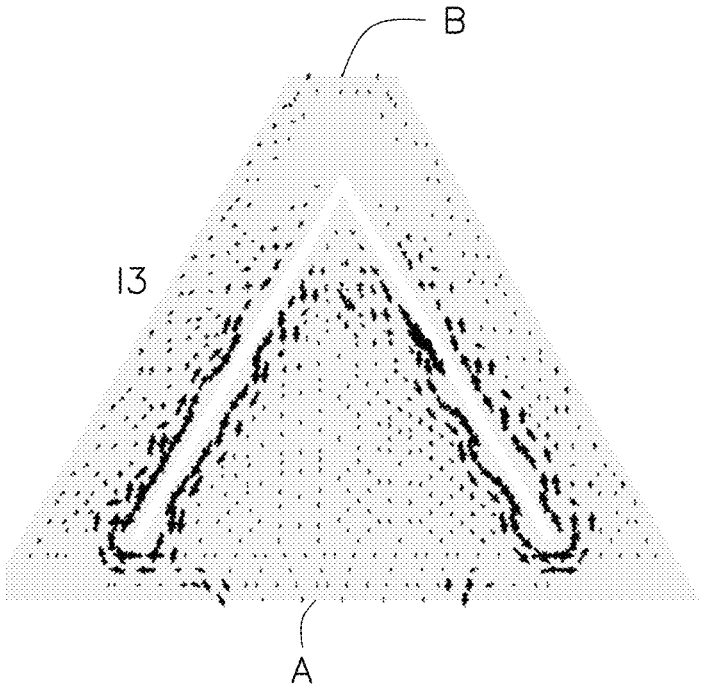
FIGS. 10A and 10B show patch surface current distributions of the second embodiment of the antenna structure in a first resonant mode and a second resonant mode when excited.
Figure 10B:
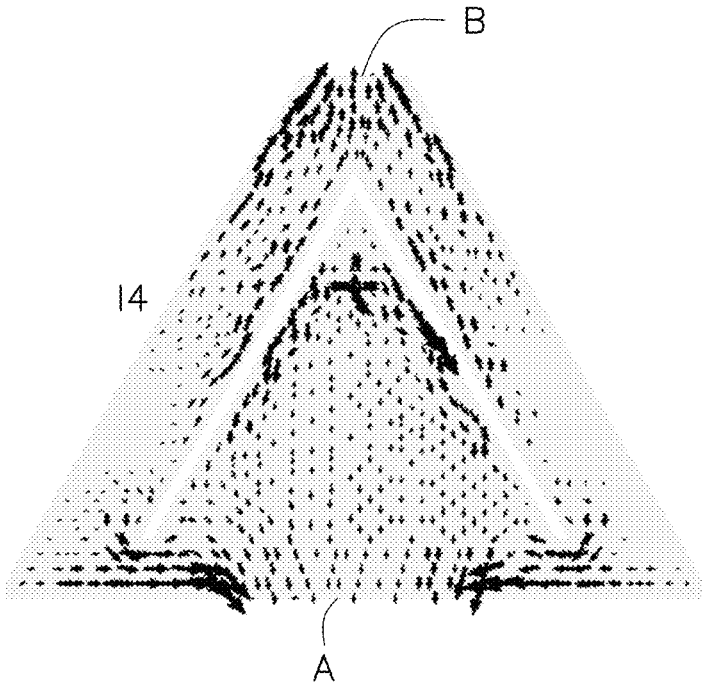
Figure 11:
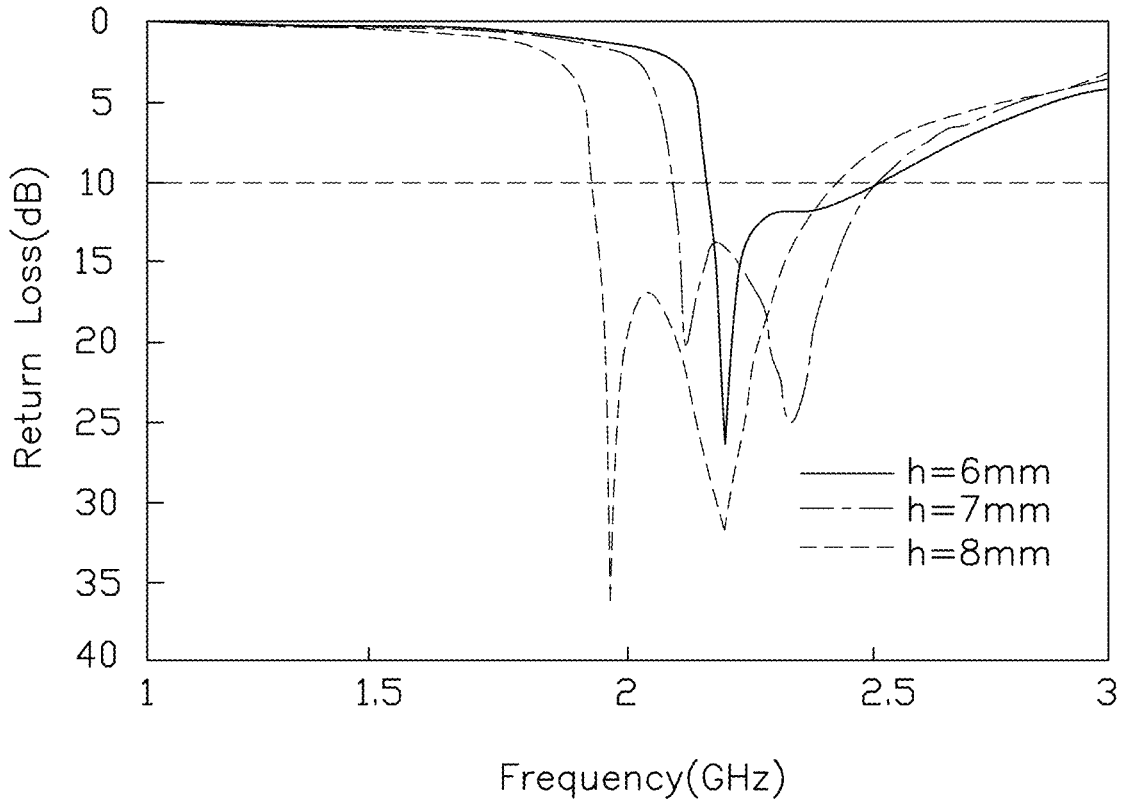
FIG. 11 is a return loss graph of a third embodiment of an antenna structure of different heights.
Figure 12A:
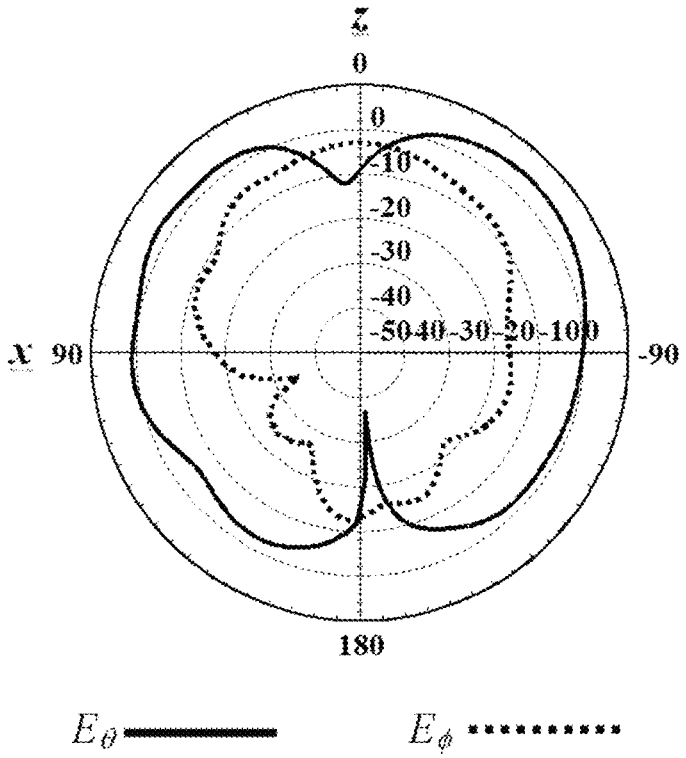
FIGS. 12A, 12B, and 12C are radiation pattern graphs of the third embodiment of the antenna structure in a first resonant mode.
Figure 12B:
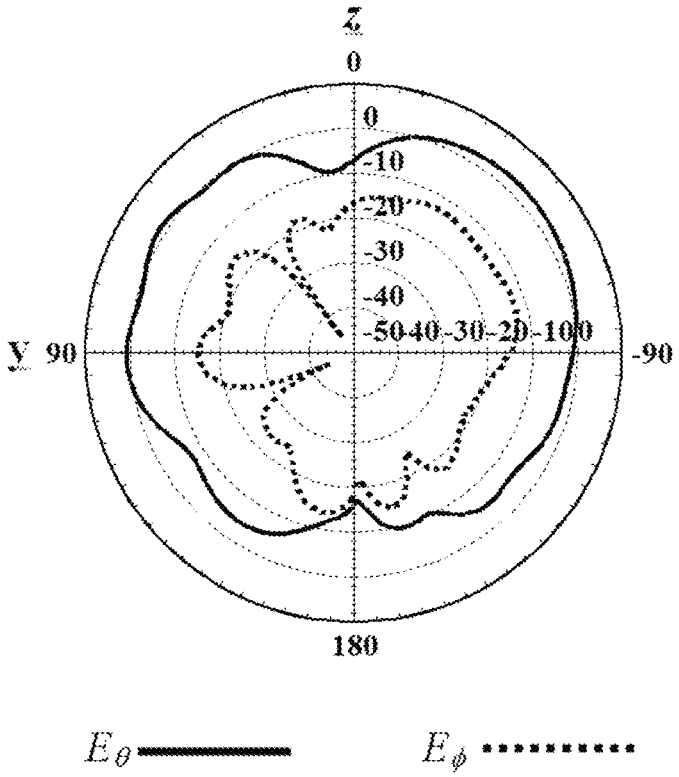
Figure 12C:
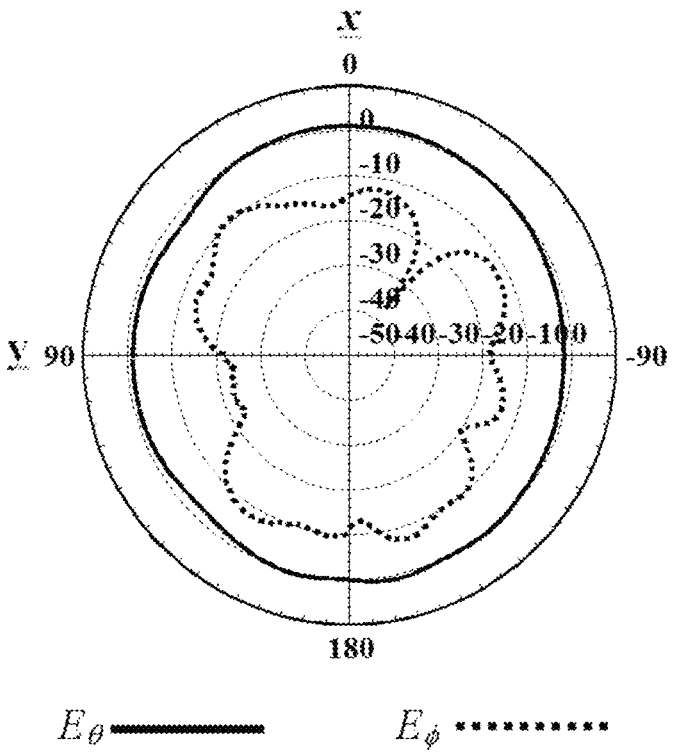

Referring to FIGS. 9, 10A, and 10B together, when the resonant frequency of the third resonant mode (M3) is about 1900 MHz, patch surface current of the third resonant mode (M3) when excited is 15. The patch surface current I5 mainly flows along the V-shaped slot. Therefore, the third resonant mode (M3) is a grounded slot mode. A resonant wavelength of the third resonant mode (M3) is about twice the perimeter of the slot 25. When the resonant frequency of the first resonant mode (TM11) is 2600 MHz, the patch surface current of the first resonant mode when excited is 16. The patch surface current I6 mainly flows along the triangle, and a current distribution of the first resonant mode is similar to that of the TM11 mode of a typical triangular microstrip antenna. From the current distributions of the antenna structure 100 operating at 1900 MHz and 2600 MHz, it can be seen that the first resonant mode (TM11) and the third resonant mode (M3) both have conical radiation patterns similar to that of a dipole antenna.

Referring to FIGS. 11, 12A, 12B, and 12C, in a third embodiment of the present disclosure, the width s of the second shorting wall B is selected for excitation of the third resonant mode (M3) and the first resonant mode (TM11). Then, the distance between the angle C and the first bottom edge 21 can be adjusted to bring the resonant frequency of the third resonant mode (M3) close to (approximately equals) the resonant frequency of the first resonant mode (TM11). Finally, the width w of the second shorting wall B and the distance d between the center to the second bottom edge 22 can be adjusted for achieving impedance matching. Therefore, antenna structures having different heights h can achieve wideband operation. In this embodiment, s=7 mm, w=27 mm, a=42 mm, d=26 mm, when the antenna structure height h is 8 mm, the antenna structure has a bandwidth of about 550 MHz, and the center frequency is about 2200 MHz.

The antenna structure 100 of the present disclosure achieves dual frequency operations by placing a second shorting wall B into the triangular PIFA antenna structure with the V-shaped slot. Thus, the antenna structure 100 can be excited in the first resonant mode (TM11) and the second resonant mode (TM21) having different radiation patterns. The antenna structure 100 can have multiple functions in practical applications, for example, indoor or short-range communication, or wireless mobile communication in surface system base station communications.

In addition, the first resonant mode (TM11) and third resonant mode (M3) can have similar radiation characteristics when the width s of the second shorting wall B is adjusted. Meanwhile, a position of the V-shaped slot can be adjusted to bring the resonant frequency of the third resonant mode (M3) close to the resonant frequency of the first resonant mode (TM11). Broadband operation with a bandwidth of up to 25% can thus be achieved.

Furthermore, the height of the antenna structure is less than 0.06 $\lambda_0$, and the operating bandwidth of the antenna structure can cover the frequency bands of 3G and WLAN (1920 MHz-2483 MHz). Therefore, the antenna structure can be applied in an intelligent household appliance.

The embodiments shown and described above are only examples. Many details are often found in the art such as the other features of the antenna structure and the intelligent household appliance. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a first patch;

a second patch, wherein the second patch is substantially an isosceles trapezoidal patch, the second patch comprises:

a first bottom edge;

a second bottom edge parallel to and space apart from the first bottom edge;

a first side edge;

a second side edge, each of the first side edge and the second side edge being connected to each of the first bottom edge and the second bottom edge;

a first shorting wall; and a second shorting wall, the first shorting wall and the second shorting wall formed between the first patch and the second patch, wherein the second patch further defines a V-shaped slot, the V-shaped slot comprises a first section parallel to and spaced apart from the first side edge, and a second section parallel to and spaced apart from the second side edge, the first section and the second section are symmetrically positioned relative to a central line of the second patch; and a substrate positioned between the first patch and the second patch.

2. The antenna structure of claim 1, wherein the first patch is grounded.

3. The antenna structure of claim 1, further comprising a connecting device, wherein the connecting device comprises a first connecting end and a second connecting end, the first connecting end is grounded, the second connecting end is connected to the second patch.

4. The antenna structure of claim 3, wherein the first connecting end passes through the first patch and the substrate and is electrically connected to the second patch.

5. The antenna structure of claim 3, wherein the second connecting end is connected to the center line of the second patch.

6. The antenna structure of claim 1, wherein the second patch is formed by placing the second shorting wall into an equilateral triangle metal patch.

7. The antenna structure of claim 6, wherein the second connecting end is connected to a center of the equilateral triangle.

8. The antenna structure of claim 1, wherein a length of each of the first section and the second section is approximately 36 mm.

9. The antenna structure of claim 1, wherein the antenna structure excites a first resonant mode and a second resonant mode, the first resonant mode has a conical radiation pattern similar to that of a dipole antenna, and the second resonant mode has a broadside radiation pattern.

10. The antenna structure of claim 9, wherein a width of the second shorting wall is adjustable, wherein as the width of the second shorting wall is increased, the antenna structure excites a third resonant mode, a resonant frequency of the third resonant mode approximately equals to a resonant frequency of the first resonant mode.

11. A intelligent household appliance comprising:

an antenna structure comprising:

a first patch;

a second patch, wherein the second patch is substantially an isosceles trapezoidal patch, the second patch comprises:

a first bottom edge;

a second bottom edge parallel to and space apart from the first bottom edge;

a first side edge;

a second side edge, each of the first side edge and the second side edge being connected to each of the first bottom edge and the second bottom edge;

a first shorting wall; and a second shorting wall, the first shorting wall and the second shorting wall formed between the first patch and the second patch, wherein the second patch further defines a V-shaped slot, the V-shaped slot comprises a first section parallel to and spaced apart from the first side edge, and a second section parallel to and spaced apart from the second side edge, the first section and the second section are symmetrically positioned relative to a central line of the second patch; and a substrate positioned between the first patch and the second patch.

12. The intelligent household appliance of claim 11, wherein the first patch is grounded.

13. The intelligent household appliance of claim 11, wherein the antenna structure comprises a connecting device, the connecting device comprises a first connecting end and a second connecting end, the first connecting end is grounded, the second connecting end is connected to the second patch.

14. The intelligent household appliance of claim 13, wherein the first connecting end passes through the first patch and the substrate and is electrically connected to the second patch.

15. The intelligent household appliance of claim 13, wherein the second connecting end is connected to the center line of the second patch.

16. The intelligent household appliance of claim 11, wherein the second patch is formed by placing the second shorting wall into an equilateral triangle metal patch.

17. The intelligent household appliance of claim 16, wherein the second connecting end is connected to a center of the equilateral triangle.

18. The intelligent household appliance of claim 11, wherein a length of each of the first section and the second section is approximately 36 mm.

19. The intelligent household appliance of claim 11, wherein the antenna structure excites a first resonant mode and a second resonant mode, the first resonant mode has a conical radiation pattern similar to that of a dipole antenna, and the second resonant mode has a broadside radiation pattern.

20. The intelligent household appliance of claim 19, wherein a width of the second shorting wall is adjustable, wherein as the width of the second shorting wall is increased, the antenna structure excites a third resonant mode, a resonant frequency of the third resonant mode approximately equals to a resonant frequency of the first resonant mode.

* * * * *